United States Patent [19]

Papaianni

[11] Patent Number: 4,729,489

[45] Date of Patent: Mar. 8, 1988

[54] COMPARTMENTALIZED TRASH CONTAINER

[76] Inventor: Carl Papaianni, 800 Pine Rd., Brielle, N.J. 08730

[21] Appl. No.: 940,922

[22] Filed: Dec. 12, 1986

[51] Int. Cl.[4] ..... B65D 25/16; B65D 1/24; B65D 21/02

[52] U.S. Cl. ..... 220/23.8; 206/518; 220/20; 220/404

[58] Field of Search ..... 220/404, 23.6, 23.8, 220/20; 206/518

[56] References Cited

U.S. PATENT DOCUMENTS

| | | | |
|---|---|---|---|
| 2,736,454 | 2/1956 | McConnell | 220/404 |
| 2,896,809 | 7/1959 | Metzger | 220/23.8 |
| 3,419,175 | 12/1968 | Laughlin | 220/19 |
| 3,651,976 | 3/1972 | Chadbourne | 220/23.8 |
| 3,760,975 | 9/1973 | Nilsson | 220/404 |
| 3,893,615 | 7/1975 | Johnson | 220/404 |
| 4,428,493 | 1/1984 | McDonough | 206/518 |

FOREIGN PATENT DOCUMENTS

| | | | |
|---|---|---|---|
| 1104627 | 7/1981 | Canada | 220/404 |
| 426614 | 6/1967 | Switzerland | 220/23.8 |

*Primary Examiner*—George E. Lowrance
*Attorney, Agent, or Firm*—Clifford G. Frayne

[57] ABSTRACT

A compartmentalized wastecan or trash container for separating categories of waste comprised of a container of a single molded piece of plastic having semi-rigid sidewalls and being interiorally traversed by at least one separator wall, thereby defining a plurality of openings in the top of the container, the separator wall positioned so as to permit the formation of an annular flange and lip about each of the plurality of openings to frictionally engage a plastic garbage bag in each of the plurality of openings.

2 Claims, 5 Drawing Figures

COMPARTMENTALIZED TRASH CONTAINER

FIELD OF INVENTION

The present invention is directed toward wastebaskets, garbage cans or waste containers of a type normally found and used in a typical kitchen and more particularly, to a compartmentalized wastebasket or garbage can which will secure plastic bags and permit the separation of various types of garbage within one container.

BACKGROUND OF THE INVENTION

For many years, the typical garbage can or wastebasket utilized in the normal kitchen was of a cylindrical or rectangular shape having a single compartment into which garbage, wastepaper and the like would be placed. When full, the garbage can or wastebasket would be emptied into larger receptacles normally stored outdoors and would be removed on a periodic basis.

The advent of plastic garbage bags presented a change in this procedure whereby the plastic garbage bag was used as a liner for the receptacle and when full, the plastic garbage bag was tied at the top and removed from the receptacle and placed in a larger receptacle for ultimate disposal. The plastic garbage bag presented a somewhat cleaner and more aesthetic approach to the collection of garbage.

Now, in many towns and municipalities throught the United States, ordinances are being enacted requiring the homeowner to separate various types of waste and garbage. In many instances, this effort is designed to reduce the amount of garbage being placed in landfills which are rapidly becoming filled and to encourage the recycling of certain materials such as aluminum and metal cans and glass. Therefore, in order to comply with such recycling efforts and the separation of garbage, the homeowner would have to obtain several of the standard cylindrical or rectangular wastebaskets. This would lead to an inconvenience in the home because of increased space required for the plurality of wastebaskets required. Additionally, the separation of garbage which is being encouraged and the recycling effort suffers from the fact that the homeowner normally will not comply unless he or she can conveniently accomplish the task.

There are multiple section wastebaskets and garbage cans available on the marketplace. See U.S. Pat. No. 4,428,493. However, these multiple section wastebaskets, while of one-piece construction, suffer from the drawback that they do not permit the homeowner to continue to utilize the convenience of plastic garbage bags which have become prevalent in our society.

Applicant's invention is directed to a compartmentalized trash container which is of one-piece construction, easily stackable, and yet permits the homeowner to continue to utilize plastic garbage can liners while at the same time providing the convenience for separation of garbage for disposal and recycling.

OBJECTS OF THE INVENTION

An object of the present invention is to provide a novel, compartmentalized wastecontainer of one piece construction Another object of the present invention is to provide a novel compartmentalized wastecontainer which is easily stackable for storage with other similar wastecontainers.

Another object of the present invention is to provide a novel, compartmentalized wastecontainer which will support plastic garbage bags in each of the compartments.

SUMMARY OF THE INVENTION

These and other objects of the present invention are derived from a compartmentalized wastecontainer having top planer openings, a closed bottom comprising a stable base, and trapezoidal sidewalls, the multi-compartmentalized wastecontainer having a first transverse inverted V-shaped groove located substantially central to said cross section extending upwardly from said closed bottom, a second partially transverse, inverted V-shaped groove perpendicular to the first inverted V-shaped groove, for ease of stacking and storing, the top planer openings being defined by multiple V-shaped grooves extending downwardly to permit each of the openings to be enclosed by an annular lip to permit each of said compartments to receive and removably secure a plastic garbage bag.

BRIEF DESCRIPTION OF THE DRAWINGS

A better understanding of the present invention as well as other objects and advantage thereof will become apparent upon consideration of the detailed disclosure thereof, especially when taken with the accompanying drawings wherein.

DETAILED DESCRIPTION OF THE DRAWINGS

Figure 1:
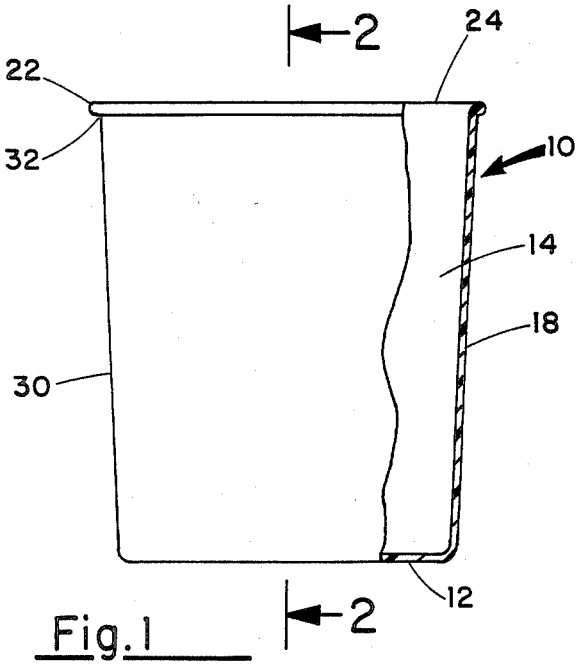
FIG. 1 is a front elevational view of the compartmentalized wastecan.
Figure 2:
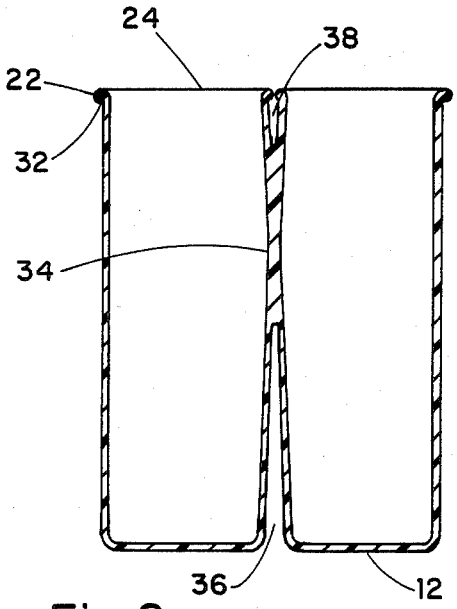
FIG. 2 is a side elevational view of the compartementalized wastecan; along axis 2—2 of FIG. 1.

Referring to FIG. 1, there is shown a front elevational view of the compartmentalized wastecan designated generally as 10. Compartmentalized wastecan 10 comprises a segmented planer base 12 and four side panels comprised as follows: A generally trapezoidal-shaped front panel 14. Compartmentalized wastecan 10 also has a generally trapezoidal-shaped rear panel 16 as can best be seen with reference to FIG. 4. Trapezoidal-shaped rear panel 16, trapezoidal-shaped front face 14 are secured to generally trapezoidal-shaped panels 18 and 20 as can best be seen by reference to FIG. 2. Front, rear and side panels 14, 16, 18 and 20 are secured to base panel 12 and terminate at an annular lip 22 which defines top 24 of compartmentalized wastecan 10, top 24 having a plurality of openings 26, 28 and 30 as can best be seen in FIG. 3 and will be discussed hereafter.

Annular lip 22 on the circumferential edge of top 24 of compartmentalized wastecan 10 extends circumferentially around top 24 and extends outwardly from side panels 14, 16, 18 and 20 so as to define an indentation 32 for securing plastic garbage bags as will be discussed hereafter.

Figure 3:
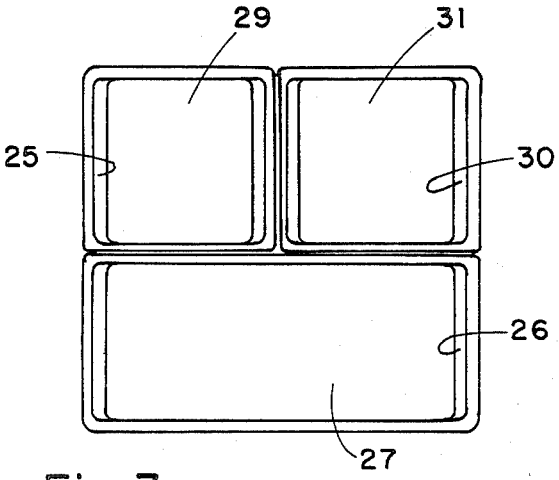
FIG. 3 is a top view of the compartmentalized wastecan.
Figure 4:
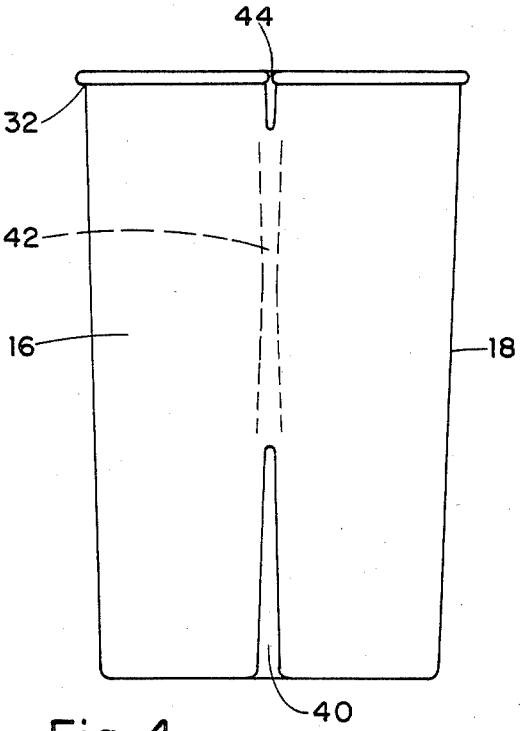
FIG. 4 is a rear elevational view of the compartmentalized wastecan.
Figure 5:
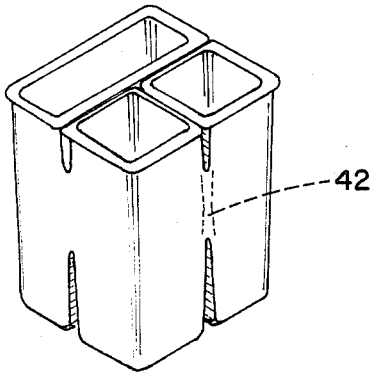
FIG. 5 is a perspective view of the compartmentalized wastecan.

This particular embodiment of the compartmentalized wastecan discloses three separate openings 26, 28 and 30 as can best be seen with reference to FIG. 3 which define chambers 27, 29 and 31 within compartmentalized wastecan 10. Chamber 27 is formed within compartmentalized wastecan 10 by a first partial common interior wall 34 and an inverted V-shaped groove 36 extending upwardly from base 12 to common interior wall 34 and a depending V-shaped groove 38 depending downwardly from top 24 to common interior wall 34.

Chambers 29 and 31 within compartmentalized wastecan 10 are formed by a second partial interior wall 42 common to compartments 29 and 31, which is perpendicular to interior common wall 34. Additionally, chambers 29 and 31 are separated by an inverted V-shaped groove 40 extending upwardly from base 12 to common interior wall 42 and a V-shaped groove 44 extending downwardly from top 24 to common interior wall 42.

In this configuration, inverted V-shaped groove 36 and V-shaped groove 38 in cooperation with common interior wall 34 bisect the interior of compartmentalized wastecan 10 into two equal chambers comprising chamber 27 on one half and chambers 29 and 31 on the second half. Inverted V-shaped groove 36 and V-shaped groove 38, together with common interior wall 34, extend the entire width of compartmentalized wastecan 10.

One-half of the interior of compartementalized wastecan 10 is further subdivided by inverted V-shaped groove 40, depending V-shaped groove 44 and common interior wall 42 which extend from the rear face 16 of compartmentalized wastecan 10 perpendicular to and intersecting with inverted V-shaped groove 36, depending V-shaped groove 38 and common interior wall 34. This thereby defines chambers 29 and 31 in compartmentalized wastecan 10.

The configuration as described above permits the easy stacking of compartmentalized wastecan 10. Base 12 is segmented into three base areas by inverted V-shaped grooves 36 and 40. This design permits compartments 27, 29 and 31 of one wastecan to be inserted into the identical compartments of another wastecan for easy stacking and storage.

Depending V-shaped grooves 38 and 44 have along their upper edge, an annular lip 22 identical to annular lip 22 which is found on the circumference of wastecan 10, this annular lip 22 also having an indentation 32 which essentially provides each chamber, 27, 29 and 31, with a circumferential lip and indentation to receive the upper portion of a plastic garbage bag in order to maintain the plastic garbage bag in position for the receipt of waste.

In this configuration, chambers 27, 29 and 31 may be used for the selective disposal of waste be it biodegradable, aluminum cans or bottles. Additionally, we recognize by one skilled in the art that a top or lid 50 may be removably secured or permanently attached to wastecan 10 so as to cover openings 26, 28 and 30 without interfering with the positioning of the plastic garbage bag.

It will be recognized by one skilled in the art that the size and shape of the compartmentalized wastecan may vary depending upon the amount of waste to be disposed of and the amount of space available for the compartmentalized wastecan itself. It will further be recognized by one skilled in the art that while the preferred embodiment disclosed herein has generally trapezoidal sidewalls, the shape of same may vary within the scope and spirit of the invention.

While the above matter describes and illustrates the preferred embodiment of the invention, it should be understood that the invention is not restricted solely to the described embodiments, but that it covers all modifications which should be apparent to one skilled in the art which would fall within the scope and spirit of the invention.

I claim:

1. A compartmentalized wastecan or trash container for separating trash into glass, metal, biodegradable trash or the like having in combination, a container consisting of a single piece of molded plastic, said container having semi-rigid outer sidewalls, said container being interiorly transversed by at least one separator wall, said separator wall comprising an upwardly extending V-shaped separator wall defining a segmented base and a downwardly depending V-shaped separator wall in alignment with said upwardly extending V-shaped separator wall, said V-shaped separator walls converging to form a vertical separator wall substantially identical in height to said outer sidewalls, said downwardly depending V-shaped separator wall defining a plurality of openings, said plurality of openings having extended horizontal outwardly therefrom, an annular circumferential flange defining an upper circumferential lip about each of said plurality of openings, said upper circumferential lip for frictionally securing a plastic disposable bag in an upright open position, said compartmentalized wastecan having a removably securable lid.

2. A compartmentalized wastecan or trash container for separating trash into glass, metal, biodegradable trash or the like having in combination, a container consisting of a single piece of molded plastic, said container having semi-rigid sidewalls, said container being interiorly transversed by a separator wall, said separator wall comprising an upwardly extending V-shaped separator wall defining a segmented base and a downwardly depending V-shaped separator wall in alignment with said upwardly extending V-shaped separator wall, said V-shaped separator walls converging to form a vertical separation wall substantially identical in height to said outer sidewalls, a second separator wall perpendicular to said first interiorly transversed separator wall, further defining the segmented base and a downwardly depending second V-shaped separator wall in alignment with said upwardly extending second V-shaped separator wall, said second V-shaped separator walls converging to form a second vertical separation wall, subsubstantially indentical in height to said outer sidewalls, said downwardly depending V-shaped separator walls defining three openings in the top of said container, said opening having extending horizontally outwardly therefrom, a circumferential annular flange defining an upper circumferential lip about each of said openings, said upper circumferential lip for frictionally securing a plastic disposable bag in an upright open position, said compartmentalized wastecan having a removably securable lid.

* * * * *